United States Patent [19]

Babbitt

[11] Patent Number: 4,773,171

[45] Date of Patent: Sep. 27, 1988

[54] SYMBOL MEANS FOR IDENTIFYING HEARING IMPAIRED PEOPLE

[76] Inventor: Norman F. Babbitt, 225 Eramo Ter., Hamden, Conn. 06518

[21] Appl. No.: 20,575

[22] Filed: Mar. 2, 1987

[51] Int. Cl.[4] ..... A44C 3/00

[52] U.S. Cl. ..... 40/299; 40/584; 434/112

[58] Field of Search ..... 40/584, 586, 324, 2 R; 116/DIG. 41; 434/112; 446/99, 100

[56] References Cited

U.S. PATENT DOCUMENTS 1,267,407 5/1918 Harrison ..... 40/584

3,234,681 2/1966 De Lucia ..... 446/100

FOREIGN PATENT DOCUMENTS 2561807 9/1985 France ..... 40/586

*Primary Examiner*—John J. Wilson

*Assistant Examiner*—Michael Lynch

*Attorney, Agent, or Firm*—CTC & Associates

[57] ABSTRACT

Symbols are provided for identifying a person as having a hearing impairment. The symbols ar affixed to an item associated with the person in such manner that the symbols are displayed to be viewed by other people. The symbol includes a pictorial representation of an ear, a designation indicating the ear(s) subject to hearing impairment, and a color coding applied to the pictorial representation indicates the degree of hearing loss. Examples of items to which the symbols may be attached include, among other items, a storm door, a screen door, an outside wall adjacent a doorbell, a house window, an eyeglass frame, an article of clothing, a cane, a walking stick, a dog harness, a dog collar, an identification card and a drivers license. The material, size and manner of attachment of the symbol to the item are dependent upon the item.

10 Claims, 2 Drawing Sheets

SYMBOL MEANS FOR IDENTIFYING HEARING IMPAIRED PEOPLE

BACKGROUND OF THE INVENTION

The present invention relates to a system of symbols for hearing impaired people, and to the use of such symbols, the symbols serving to identify people with impaired hearing, and to indicate which ear is affected, or both, and to give the degree of hearing loss.

Hearing impairment is the most prevalent physical disability in the United States of America, yet hearing impairment receives far less attention than seems justified. According to the latest statistics compiled by the American Hearing Research Foundation of Chicago, Ill., there are an estimated 13.4 million hearing impaired people in this country, and the number increases steadily every year. A higher percentage of men than women is prevocationally deaf, a long standing fact which has repeated in every decennial census since 1830.

The following United States Patents may be of interest to the reader as background information, although none of them seem pertinent to the present invention:

| Patent Number | Date | Inventor(s) |
|---|---|---|
| 1,691,456 | November 13, 1928 | Beck |
| 2,871,485 | February 3, 1959 | Greco |
| 3,472,198 | October 14, 1969 | Rinecker |
| 4,179,833 | December 25, 1979 | Knodel |
| 4,375,133 | March 1, 1983 | Fenrich et al. |
| 4,581,271 | April 8, 1986 | Gordon |

Beck discloses a sign for use by a blind person at street intersections, to indicate that handicap to motorists. The sign has opposite faces that are identical and has a hole whereby the upright position of the sign can be determined by the sense of touch.

Greco teaches a garment provided with readily interchangeable indicia enabling the wearer, at will, to display specialized insignia such as fraternity or sorority insignia, club insignia, or avocation insignia, such as having to do with yachting, aviation or equestrianism.

Rinecker discloses a signaling device that is wearable on an article of clothing. The device has an indicator with a daytime visible portion and a nighttime visible portion. A member is secured to the article of clothing directly over the indicator and is movable to cover one or the other of the portions.

Knodel teaches an information reminding device having a strap-like body portion wearable on a person's wrist. The body portion carries a tab with an area for carrying a reminding message on one or both sides.

Fenrich et al. presents an information tab holder for attachment to clothing during athletic activities. The tag has an elongated pouch for receiving an information bearing insert. The information may be of medical nature.

Gordon discloses an ID tag usable with indicia means, storable within the tag.

It is an important object of the invention to provide a simple system of symbols for hearing impaired people to identify them as such, to identify the ear(s) affected and to give the degree of the impairment.

It is a further object to provide such a system that is simple, attractive and inexpensive.

Additional objects and advantages will appear hereinafter.

SUMMARY OF THE INVENTION

The invention presents a combination comprising symbol means for identifying a person as having a hearing impairment, and an item associated with the person. The symbol means includes a pictorial representation of an ear, and the symbol means is affixed to the item in such manner that the symbol means is displayed to view by other people. The symbol means further includes a designation indicating the ear(s) subject to hearing impairment. A color coding indicates the degree of hearing loss. The color coding is applied to the pictorial representation of the ear. More specifically, the ear designation is the letter L (for left ear impairment), the letter R (for right ear impairment) or the letters L and R (for impairment in both ears), and the color coding is green (for up to 25% loss of hearing), blue (for 25% to 50% loss of hearing), amber (for 50% to 75% loss of hearing) and red (for 75% to 100% loss of hearing). The color of the ear designation is black.

Examples of the item to which the symbol means is attached include, among many others, a storm door, a screen door, an outside wall adjacent a doorbell, a house window, an eyeglass frame, an article of clothing, a cane, a walking stick, a dog harness and a dog collar. The material, size and manner of attachment of the symbol means to the item are dependent upon the item.

Preferably, the pictorial representation and the ear designation are of luminous material so that they can be seen in the dark.

DESCRIPTION OF THE INVENTION

Figure 1:
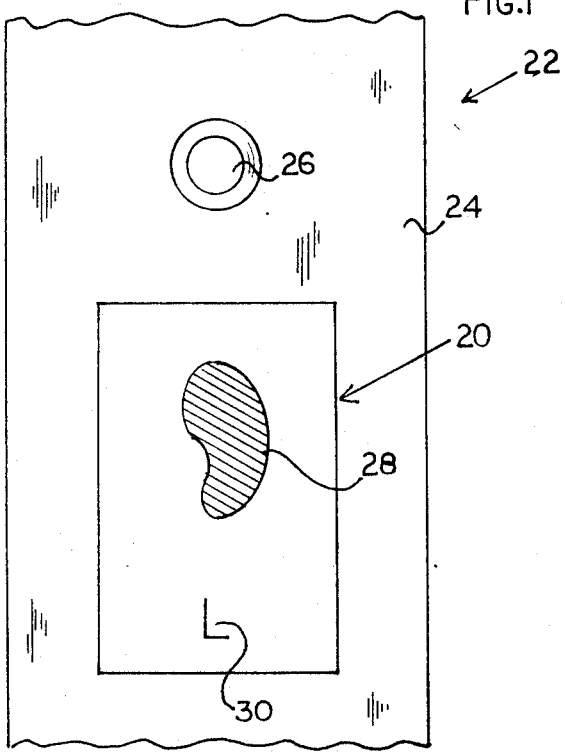
FIG. 1 is a front elevation of a symbol means that is a preferred element of a combination of a symbol means-item combination embodying the invention, the item being the outside wall of a house, on a door frame adjacent a doorbell, the symbol means indicating an impairment of up to 25% in the left ear.

FIG. 1 shows a combination of a symbol means 20 for identifying a person as having a hearing impairment and an item 22 to which the symbol means is affixed. The item is associated with the hearing impaired person and the symbol means conveys the message to other people that the person with whom the symbol means is associated suffers from a hearing impairment. More particularly, symbol means 20 is shown affixed to the outside wall or door frame 24 of a house adjacent a doorbell 26.

Symbol means 20, which for this use may be rectangular, about two inches (5.08 cm) wide by four inches (10.16 cm) high, bears a color coded green pictorial representation 28 of an ear, indicating a hearing impairment of up to 25%, and beneath representation 28 is a designation 30, indicating the affected ear. Designation 30 as shown in FIG. 1 is the letter "L", indicating that the left ear is the affected ear.

Thus, the message conveyed by symbol means 20 is that the person with whom symbol means 20 is associated has a left ear hearing impairment of up to 25%.

Figure 2:
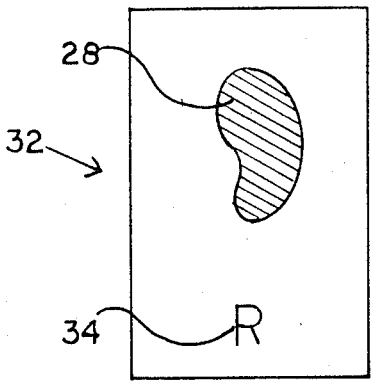
FIG. 2 is a front elevation of a symbol means that is a preferred element of a symbol means-item combination, the symbol means indicating an impairment of up to 25% in the right ear.

FIG. 2 shows a symbol means 32 similar to symbol means 20 including green pictorial representation 28 of an ear, but a designation 34 in the form of the letter "R", thus indicating a hearing impairment of up to 25% in the right ear.

Figure 3:
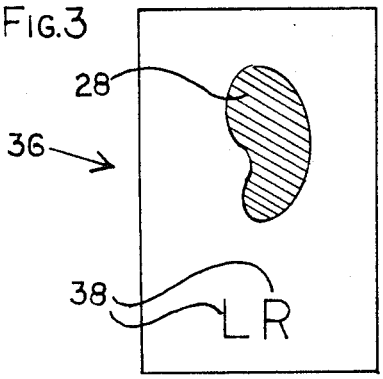
FIG. 3 is a view similar to FIG. 2, the symbol means indicating an impairment of up to 25% in both ears.

FIG. 3 shows a symbol means 36 similar to symbol means 20 including green pictorial representation 28, but a designation 38 in the form of the letters L and R, thus indicating a hearing impairment of up to 25% in both ears.

Figure 4:
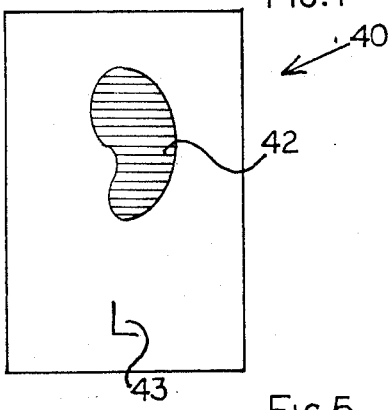
FIG. 4 is a view similar to FIG. 2, the symbol means indicating an impairment of 25% to 50% in the left ear.

FIG. 4 shows a symbol means 40 similar to symbol means 20 including a blue pictorial representation 42 of an ear and a designation 43 in the form of the letter L, thus indicating a hearing impairment of 25% to 50% in the left ear.

Figure 5:
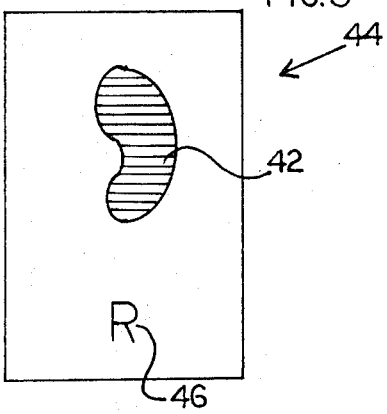
FIG. 5 is a view similar to FIG. 2, the symbol means indicating an impairment of 25% to 50% in the right ear.

FIG. 5 shows a symbol means 44 similar to symbol means 40 including blue representation 42 and a designation 46 in the form of the letter R, thus indicating a hearing impairment of 25% to 50% in the right ear.

Figure 6:
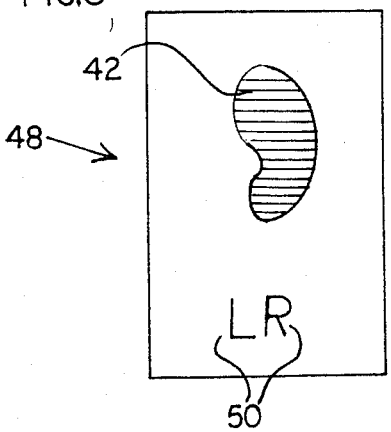
FIG. 6 is a view similar to FIG. 2, the symbol means indicating an impairment of 25% to 50% in both ears.

FIG. 6 shows a symbol means 48 similar to symbol means 40 including blue representation 42 and a designation 50 in the form of the letters L and R, thus indicating a hearing impairment of 25% to 50% in both ears.

Figure 7:
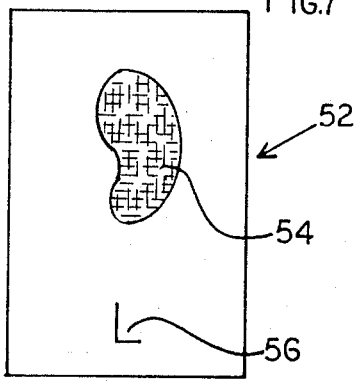
FIG. 7 is a view similar to FIG. 2, the symbol means indicating an impairment of 50% to 75% in the left ear.

FIG. 7 shows symbol means 52 similar to symbol means 20 including an amber pictorial representation 54 of an ear and a designation 56 in the form of the letter L, thus indicating a hearing impairment of 50% to 75% in the left ear.

Figure 8:
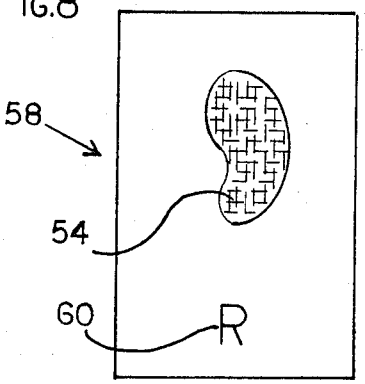
FIG. 8 is a view similar to FIG. 2, the symbol means indicating an impairment of 50% to 75% in the right ear.

FIG. 8 shows a symbol means 58 similar to symbol means 52 including amber representation 54 and a designation 60 in the form of the letter R, thus indicating a hearing impairment of 50% to 75% in the right ear.

Figure 9:
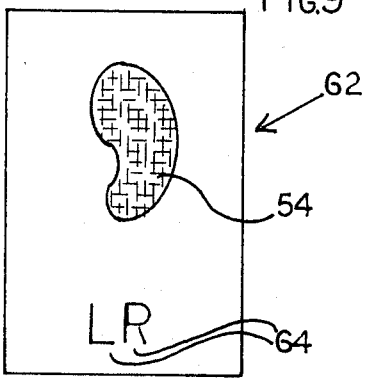
FIG. 9 is a view similar to FIG. 2, the symbol means indicating an impairment of 50% to 75% in both ears.

FIG. 9 shows a symbol means 62 similar to symbol means 52 including amber representation 54 and a designation 64 in the form of the letters L and R, thus indicating a hearing impairment of 50% to 75% in both ears.

Figure 10:
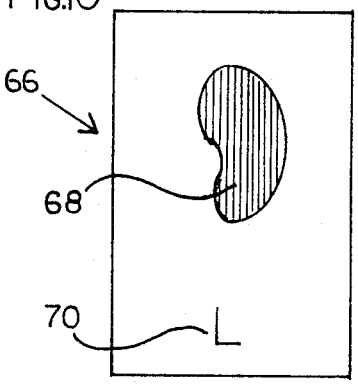
FIG. 10 is a view similar to FIG. 2, the symbol means indicating an impairment of 75% to 100% in the left ear.

FIG. 10 shows a symbol means 66 similar to symbol means 20 including a red pictorial representation 68 of an ear and a designation 70 in the form of the letter L, thus indicating a hearing impairment of 75% to 100% in the left ear.

Figure 11:
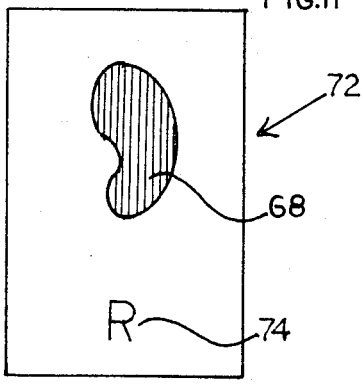
FIG. 11 is a view similar to FIG. 2, the symbol means indicating an impairment of 75% to 100% in the right ear.

FIG. 11 shows a symbol means 72 similar to symbol means 66 including red pictorial representation 68 and a designation 74 in the form of the letter R, thus indicating a hearing impairment of 75% to 100% in the right ear.

Figure 12:
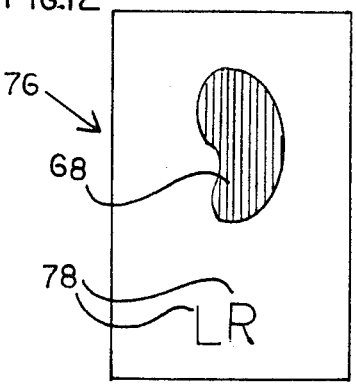
FIG. 12 is a view similar to FIG. 2, the symbol means indicating an impairment of 75% to 100% in both ears.

FIG. 12 shows a symbol means 76 similar to symbol means 66 including red pictorial representation 68 and a designation 78 in the form of the letters L and R, thus indicating a hearing impairment of 75% to 100% in both ears.

In each case the designation of the affected ear(s) is black, and the symbol means has color coding to indicate the extent of the impairment, green indicating up to 25% impairment, blue between 25% and 50% impairment, amber between 50% and 75% impairment and red between 75% and 100% impairment, the color coding being applied to the pictorial representation of the ear.

The size, material and means of affixation of the symbol means to the item which is to display the same are dictated largely by the nature of the item. Thus, for example, symbol means 20, 32, 36, 40, 44, 48, 52, 58, 62, 66, 72 and 76 may be of suitable plastic and have reverse faces provided with self-sticking material.

It is evident that the invention attains the stated objects and advantages and others.

The disclosed details are exemplary only and are not to be taken as limitations on the invention except as those details may be included in the appended claims.

What is claimed is:

1. A combination comprising symbol means for identifying a person as having a hearing impairment, and an item associated with the person, said symbol means including a pictorial representation of an ear, said symbol means being affixed to said item in such manner that said symbol means is displayed to be viewed by other people.

2. A combination according to claim 1 wherein said symbol means further includes a designation indicating the ear(s) subject to hearing impairment.

3. A combination according to claim 2 wherein said symbol means further includes a color coding indicating the degree of hearing loss.

4. A combination according to claim 3 wherein said color coding is applied to said pictorial representation.

5. A combination according to claim 3 wherein said ear designation is selected from the letter L (for left ear), the letter R (for right ear) and the letters L and R (for both ears) and said color coding is selected from the color green (indicating up to 25% loss), the color blue (indicating 25% to 50% loss), the color amber (indicating 50% to 75% loss) and the color red (indicating 75% to 100% loss).

6. A combination according to claim 5 wherein the color of said ear designation is black.

7. A combination according to claim 1 wherein said item is a member of a group including a storm door, a screen door, an outside wall adjacent a doorbell, a house window, an eyeglass frame, an article of clothing, an automobile window, fire fighting emergency equipment, a cane, a walking stick, a dog harness, a dog collar, an identification card and a drivers license.

8. Symbol means for identifying a person as having a hearing impairment, said symbol means including a pictorial representation of an ear, a designation indicating the ear(s) subject to hearing impairment and a color coding indicating the degree of hearing loss.

9. Symbol means according to claim 8 further including a color coding indicating the degree of hearing loss.

10. Symbol means according to claim 9 wherein said color coding is applied to said pictorial representation.

* * * * *